United States Patent [19]
Hohne
[11] 4,298,162
[45] Nov. 3, 1981

[54] DECANTER CENTRIFUGE

[75] Inventor: Per Høhne, Valby, Denmark
[73] Assignee: Alfa-Laval Separation A/S, Søborg, Denmark

[21] Appl. No.: 115,170
[22] Filed: Jan. 25, 1980
[30] Foreign Application Priority Data
Feb. 23, 1979 [DK] Denmark ..... 806/79
[51] Int. Cl.³ ..... B04B 1/20
[52] U.S. Cl. ..... 233/7; 233/24
[58] Field of Search ..... 233/7, 19 A, 23 R, 24, 233/19 R, 27, 4

[56] References Cited
U.S. PATENT DOCUMENTS

| | | | |
|---|---|---|---|
| 2,955,753 | 10/1960 | O'Conor . | |
| 3,494,542 | 2/1970 | Graig | 233/7 |
| 3,734,399 | 5/1973 | Das | 233/7 |
| 3,923,241 | 12/1975 | Cyphelly | 233/24 |
| 4,073,431 | 2/1978 | Jager | 233/7 |
| 4,113,171 | 9/1978 | Cyphelly | 233/7 |
| 4,228,949 | 10/1980 | Jackson | 233/24 |

*Primary Examiner*—Robert W. Jenkins
*Attorney, Agent, or Firm*—Beveridge, DeGrandi & Kline

[57] ABSTRACT

A system for controlling the relative rpm. of the conveyor screw of a decanter centrifuge includes a gear interconnecting the screw and the centrifuge drum. The gear has an input shaft the rpm. of which determines the relative rpm. of the screw, and a housing rotating in synchronism with the drum. The input shaft and the housing are coupled to one each of two rotary, positive displacement machines one of which is a constant displacement machine while the other is a variable displacement machine. The machines are hydraulically connected in series in a closed circuit so that a change in the displacement volume of the variable machine, at constant rpm. of the gear housing, results in a change in the rpm. of the input shaft. The variable displacement machine may be mechanically coupled to a further constant displacement machine whereby the flow rate through the variable displacement machine is reduced to the difference between the flow rates through the other two machines.

6 Claims, 2 Drawing Figures

DECANTER CENTRIFUGE

BACKGROUND OF THE INVENTION

The present invention relates to a decanter centrifuge comprising a motor-driven rotary drum, a conveyor screw located within said drum and rotatable relative thereto for conveying solid material separated from a raw material supplied to the drum, a mechanical gearing connecting said drum and said conveyor screw, said gearing including a housing rigidly connected to said drum and an input shaft the rpm. of which determines the rpm. of the screw relative to the drum.

By adjusting or varying the rpm. of the input shaft of the gearing it is possible to change the conveying rate of the screw and thus adapt that rate to the prevailing operational conditions, e.g. in order to obtain a minimum of solids in the liquid phase discharged and/or a maximum dewatering of the solids, or in order to prevent overloading of the centrifuge in case the content of solids in the raw material is particularly high.

SUMMARY OF THE INVENTION

According to the invention there is provided a centrifuge of the kind referred to above, further comprising a first positive displacement type hydraulic machine having a constant displacement volume, a second positive displacement type hydraulic machine having a variable displacement volume, first power transmitting means connecting one of said first and second hydraulic machines with the housing of said gearing, second power transmitting means connecting the other of said hydraulic machines with the input shaft of the gearing, and conduit means connecting said first and second hydraulic machines in a closed hydraulic circuit.

The invention makes it possible to control the rpm. of the input shaft of the gearing and thus the relative rpm. of the conveyor screw in a very simple and reliable way. Due to the series connection between the first and second hydraulic machines, the flow rate through each machine is the same, and because the respective rotational speeds of the machines are proportional to the rotational speed of the drum and the input shaft, respectively, there will be maintained a constant relative rpm. of the conveyor screw as long as the volume adjustment of the variable displacement machine is maintained unaltered. Changing the displacement volume of the variable displacement machine results directly in a change of the rpm. of the input shaft of the gearing and, hence, of the relative rotational speed of the conveyor screw. Dependent on the operational conditions either hydraulic machine can operate as a pump and the other machine as a motor in the hydraulic circuit and in either case the control takes place without the supply of external energy. It thus does not require a separate drive motor as in known control systems in which the input shaft of the gearing is driven by a variable speed motor and where problems may arise when it is desired to maintain a constant rpm. irrespective of load changes.

In a preferred embodiment of the invention the hydraulic machine connected with the input shaft of the gearing through said second power transmitting means is the constant displacement machine. An advantage of this embodiment is that a constant ratio exists between the liquid pressure in the hydraulic circuit and the torque acting on the input shaft of the gearing. The maximum value of said torque can then be determined by correspondingly adjusting a pressure relief valve in the circuit.

In a further embodiment of the invention there is provided a third positive displacement type hydraulic machine having a constant displacement volume, means mechanically connecting said third hydraulic machine with the housing of the gearing, and the hydraulic circuit includes conduit means connecting said third hydraulic machine in series with said first hydraulic machine and in parallel with said second hydraulic machine. The flow rate in the hydraulic circuit is then determined by the total volumetric capacity of the second and third hydraulic machines, and since the desired range of variation of the relative rpm. of the conveyor screw and, hence, of the flow rate through the variable displacement machine is generally relatively small, it is possible to let the major part of the flow go through the constant displacement machine whereby the control may be effected with a variable displacement machine of relatively low displacement volume. This is advantageous because a constant displacement machine is substantially cheaper than a variable displacement machine having the same maximum displacement volume and may operate at higher rotational speeds.

A structural simplification of the control system may be obtained by providing a common drive shaft for driving the two hydraulic machines connected to the housing of the gearing.

The displacement volume of the second hydraulic machine may be variable in such a way as to permit a reversal of the flow direction through the machine without changing the direction of its rotation. In a system with only two hydraulic machines it is then possible to reverse the direction of rotation of the input shaft to the gearing, and in a system having three hydraulic machines the flow rate through the variable displacement machine will—dependent on the adjustment of that machine—be either added to or subtracted from the flow rate through the parallel-connected constant displacement machine. In both cases there is thus obtained a larger range of variation of the relative rpm. of the conveyor screw.

The centrifuge may be provided with a controller for simultaneously controlling the adjustment of the displacement volume of said second hydraulic machine and the supply of chemicals, such as a flocculating agent, to the raw material being processed in the centrifuge. The input to such a controller may be a parameter relevant to the separation process in the centrifuge, such as the purity of the discharged liquid phase, the inflow rate of raw material, the proportion of solids in the raw material or the pressure in the hydraulic circuit which is proportional to the torque on the conveyor screw and, hence, representative of the amount of solids.

BRIEF DESCRIPTION OF THE DRAWINGS

The invention will now be described in more detail with reference to the accompanying drawings, in which.

DETAILED DESCRIPTION

Figure 1:
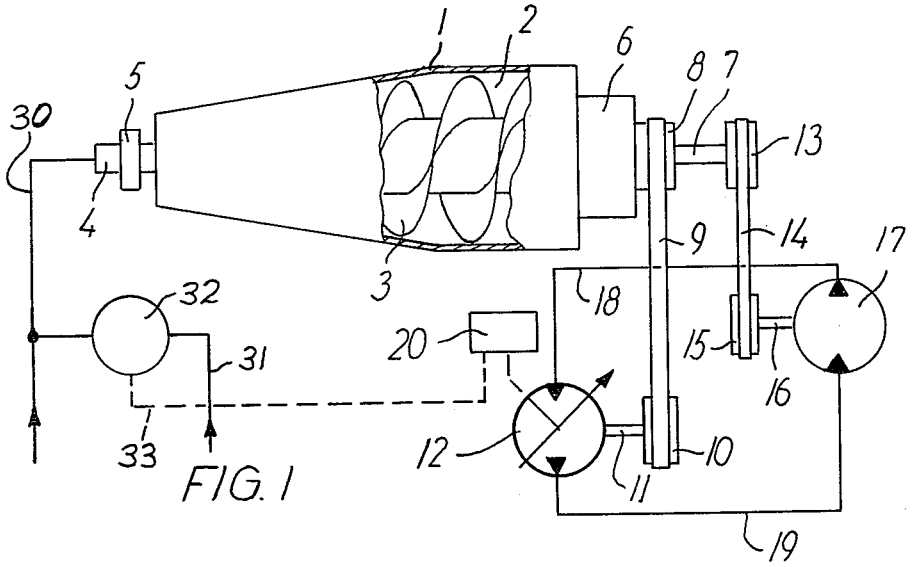
FIG. 1 is a schematic elevation, partly in section, of a first decanter centrifuge with associated control system embodying the invention.

In both embodiments shown the decanter centrifuge as such is of conventional design and comprises a bowl or drum 1 supported for rotation in a frame (not shown). On part of its length drum 1 is cylindrical and the remainder of the drum length is conical with decreasing diameter towards an outlet (not shown) for the discharge of solids, which have been separated out from a raw material supplied to the separating space 2 of the drum. A conveyor screw 3 is supported for rotation within the drum, and through the drive mechanism described in more detail below the screw is rotated in the same direction as the drum but with a slightly different rpm. whereby it conveys the solids towards the associated discharge end, i.e. the left-hand end of FIGS. 1 and 2. The purified liquid phase is discharged through a liquid outlet (not shown) at the opposite drum end. For the general design of the centrifuge, reference may be had to the specification of U.S. Pat. No. 3,971,509 issued July 27, 1976 to F. B. Johnsen.

Drum 1 is driven from a main drive motor (not shown) which, e.g. through a belt drive, is connected to a stub shaft 4 protruding from the left-hand end of the drum and supported in a schematically shown bearing 5. Conveyor screw 3 is driven from the drum to which it is coupled through a reduction gearing (not shown in detail), e.g. a planetary gear, the housing 6 of which is secured to the right-hand end of drum 1. Such gearings are well-known for driving the conveyor screw of a decanter centrifuge and will, therefore, not be described in detail. The gearing comprises a protruding input shaft 7 the rpm. of which determines, through the gearing, the rpm. of screw 3 relative to drum 1.

Housing 6 is integral with a pulley 8 which through a belt 9 is drivingly connected to a pulley 10 secured to a shaft 11 of a rotary, variable displacement machine 12. To input shaft 7 of the gearing is secured a pulley 13 which through a belt 14 is drivingly connected to a pulley 15 secured to the shaft 16 of a rotary, constant displacement machine 17. Machines 12 and 17 are hydraulically connected in series in a closed circuit including hydraulic conduits 18 and 19.

For the adjustment of the displacement volume of the variable displacement machine 12 the drawings schematically show a controller 20. As mentioned above a parameter relevant to the process taking place in the centrifuge can be chosen as the input variable of the controller, but alternatively the controller could be replaced or supplemented by manually operable means for adjusting the displacement volume.

When, during operation of the centrifuge, drum 1 rotates at a constant rpm. the rpm. of gear housing 6 and thus of shaft 11 will also be constant. The flow rate through machine 12 will, however, depend on the adjusted displacement volume of that machine, and since the flow rate through the series-connected constant displacement machine 17 is the same, the rpm. of the latter's shaft 16 will vary in dependence on the flow rate and, hence, of the adjusted displacement volume of machine 12. This adjustment thus defines the rpm. of input shaft 7 of the gear and thus the relative rpm. of screw 3, i.e. the difference between the rpm. of the screw and the rpm. of the drum.

When the adjustability of the variable displacement machine 12 is such that with constant direction of rotation of shaft 11, the flow through the machine can optionally take place in either direction, it is possible to reverse the flow direction in the hydraulic circuit and, hence, the direction of rotation of shaft 16 and of input shaft 7 of the gear. In this way the range of variation of the relative rpm. of screw 3 is increased.

Figure 2:
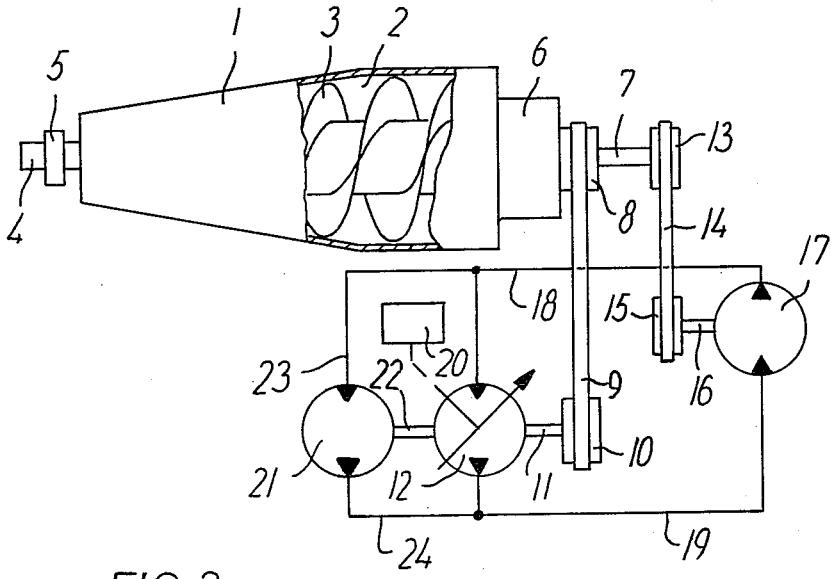
FIG. 2 is a corresponding schematic view of a second embodiment of the invention.

All component parts described above are present in both embodiments shown and have been designated by the same reference numerals in FIG. 1 and FIG. 2. The embodiment of FIG. 2 further includes a third positive displacement machine 21 which is a constant displacement machine driven from the gear housing 6. As shown machine 21 is directly coupled to machine 12 through a shaft 22, but it will be understood that it could also be driven through a separate transmission from gear housing 6 and at a different speed than machine 12. Through two hydraulic conduits 23 and 24 machine 21 is connected to conduits 18 and 19, respectively, and thus series-connected with the constant displacement machine 17.

When the flow directions through the mechanically coupled machines 12 and 21 are as shown by arrows in FIG. 2, the flow rate through machine 17 is equal to the sum of the flow rates through the two other machines. If the flow through machine 12 can be reversed without changing the direction of rotation, as mentioned above in connection with FIG. 1, the flow rate through machine 17 becomes equal to the difference between the flow rates through the two other machines.

As indicated above it is an advantage of the embodiment of FIG. 2 that the major part of the flow rate through machine 17, which determines the rpm. of shaft 7, can be delivered by the constant displacement machine 21 so that the variable displacement machine 12 can be dimensioned with a relatively low maximum displacement volume determined solely by the required range of the variation of the rpm. of shaft 7.

Even if not shown in the drawings it will be understood that the hydraulic circuit will normally include various conventional component parts, such as one or more relief valves and a make-up pump for compensating losses of hydraulic liquid due to leakage. There may also be included an alarm device which responds when the pressure in the hydraulic circuit reaches a value indicating the risk of overload of the decanter centrifuge.

I claim:

1. A decanter centrifuge comprising a motor-driven rotary drum, a conveyor screw located within said drum and rotatable relative thereto for conveying solid material separated from a raw material supplied to the drum, a mechanical gearing connecting said drum and said conveyor screw, said gearing including a housing rigidly connected to said drum and an input shaft the rpm. of which determines the rpm. of the screw relative to the drum, a first positive displacement type hydraulic machine having a constant displacement volume, a second positive displacement type hydraulic machine having a variable displacement volume, first power transmitting means connecting one of said first and second hydraulic machines with the housing of said gearing, second power transmitting means connecting the other of said hydraulic machines with the input shaft of said gearing, and conduit means connecting said first and second hydraulic machines in a closed hydraulic circuit.

2. A decanter centrifuge as claimed in claim 1 in which the hydraulic machine connected with the input shaft of the gearing through said second power transmitting means is the constant displacement machine.

3. A decanter centrifuge as claimed in claim 2 further comprising a third positive displacement type hydraulic machine having a constant displacement volume, means mechanically connecting said third hydraulic machine with the housing of the gearing, and wherein said hydraulic circuit includes conduit means connecting said third hydraulic machine in series with said first hydraulic machine and in parallel with said second hydraulic machine.

4. A decanter centrifuge as claimed in claim 3, wherein said second and third hydraulic machines are arranged on a common drive shaft.

5. A decanter centrifuge as claimed in claim 1 or claim 3, wherein the displacement volume of said second hydraulic machine is variable in such a way as to permit a reversal of the flow direction through the machine without changing the direction of its rotation.

6. A decanter centrifuge as claimed in claim 1, further comprising controller means for simultaneously controlling the adjustment of the displacement volume of said second hydraulic machine and the supply of chemicals, such as a flocculating agent, to the raw material being processed in the centrifuge.

* * * * *